United States Patent [19]

Guertin

[11] 4,375,288

[45] Mar. 1, 1983

[54] AMERICAN FAMILY TREE GAME

[76] Inventor: Joseph G. Guertin, 233 Benedict Rd., Pittsfield, Mass.

[21] Appl. No.: 267,514

[22] Filed: Jun. 22, 1981

[51] Int. Cl.[3] ..... A63F 3/00

[52] U.S. Cl. ..... 273/273

[58] Field of Search ..... 273/269, 273, 274; 434/154

[56] References Cited

U.S. PATENT DOCUMENTS

| | | | |
|---|---|---|---|
| 2,464,146 | 3/1949 | Mohler | 273/269 |
| 3,564,732 | 2/1971 | Lynd | 434/167 |
| 3,970,313 | 7/1976 | Montemayor | 273/243 |
| 4,201,386 | 5/1980 | Seale | 273/236 |
| 4,230,321 | 10/1980 | Smith | 273/308 |

*Primary Examiner*—Harland S. Skogquist

[57] ABSTRACT

A family tree panel which includes a plurality of insertion slots arranged each at one end of a plurality of interconnected branches is used to generate a family tree representation. A plurality of insertable tokens containing facial indicia representative of a particular relative is used to insert within the slots within the family tree. A deck of special cards indicating historic cities, surnames, ancestors and various investigative methods, as well as inheritances, are used to determine the placement of the relative slots within the family tree. Both the paternal and maternal family history is portrayed within the particular slots on the family tree. A particular arrangement of the research cards and relative cards allows the players, in turn, to place the ancestral tokens on the tree. The first player to place all the tokens within the tree completes his or her family history and wins the game.

2 Claims, 5 Drawing Figures

Fig. 3.

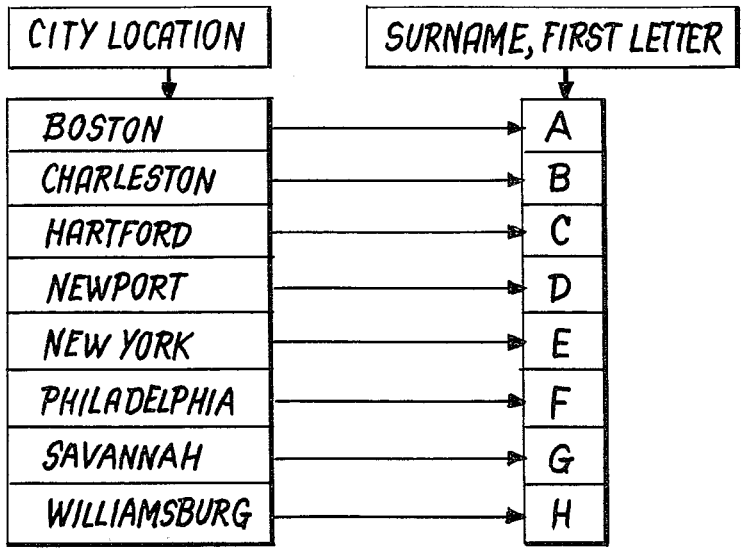

Fig. 4.

| | |
|---|---|
| MOTHER | CITY VITAL RECORDS |
| FATHER | CITY VITAL RECORDS |
| BROTHER | CITY VITAL RECORDS |
| SISTER | CITY VITAL RECORDS |
| AUNTS AND UNCLES | CITY VITAL RECORDS |
| MATERNAL GRANDPARENTS | CITY VITAL RECORDS |
| PATERNAL GRANDPARENTS | CITY VITAL RECORDS |
| MATERNAL GREAT-GRANDPARENTS | CHURCH VITAL RECORDS |
| PATERNAL GREAT-GRANDPARENTS | CHURCH VITAL RECORDS |
| MATERNAL GR.-GREAT GRANDPARENTS | CHURCH VITAL RECORDS |
| PATERNAL GR.-GREAT GRANDPARENTS | CHURCH VITAL RECORDS |
| MATERNAL GR.-GR.-GR. GRANDPARENTS | ARCHIVES VITAL RECORDS |
| PATERNAL GR.-GR.-GR. GRANDPARENTS | ARCHIVES VITAL RECORDS |
| MATERNAL GR.-GR.-GR.-GR. GRANDPARENTS | ARCHIVES VITAL RECORDS |
| PATERNAL GR.-GR.-GR.-GR. GRANDPARENTS | ARCHIVES VITAL RECORDS |

FAMILY TREE

AMERICAN FAMILY TREE GAME

BACKGROUND OF THE INVENTION

Educational games can be used to help teach ancestral family relationships by generating a succession of generations for each player. U.S. Pat. No. 4,230,321, utilizes a plurality of playing cards to teach the manner in which the individual members of plural generations of a family chain are related to one another. U.S. Pat. No. 786,022 describes a game of royalty wherein a plurality of playing cards is employed to generate governing dynasties belonging to the early kingdom of England. The game teaches the history of the royal English families.

U.S. Pat. No. 3,970,313 discloses an educational and recreational game teaching players how to arrange fictitious ancestors on an ancestral chart. The game includes a multisided playing board having a continuous peripheral course divided into a plurality of interconnected playing spaces. A plurality of ancestor cards in combination with playing die are used to generate each player's ancestry. The first player to complete his family tree is the winner. U.S. Pat. No. 4,201,386 utilizes a three-dimensional chart to portray the ancestral relationships of the players' relative to imaginary royal pedigrees.

The object of this invention is to develop the family tree of each player relative to a historic American city. The invention teaches the players how to use various research methods to determine their own family history.

SUMMARY OF THE INVENTION

A deck of cards portraying American cities, relatives and research methods is used in combination with a family tree panel to determine each player's family history. Pairing the relative and research cards enables a player to acquire a token for insertion within one of a plurality of slots on the family tree panel. The first player to complete the family tree panel wins the game.

BRIEF DESCRIPTION OF THE DRAWINGS

FIG. 3 is a chart equating various city locations with the first letter of the ancestral surname of each of the players;

FIG. 4 is a chart showing the pairing between relative cards and research cards required for obtaining an ancestral token.

DESCRIPTION OF THE PREFERRED EMBODIMENT

The purpose of this invention is to develop an appreciation for family history research in the United States of America. The American historical scene is the background for this game wherein early American cities represent the home city for each player. Eight American cities are portrayed and each of the players' surnames is denoted by a single capital letter indicated upon an appropriate playing card. A player can add letters to the surname to complete the name on the panel for player identification, if so desired. The paternal and maternal relationships to the player are depicted in progression upon a family tree panel.

Figure 1:
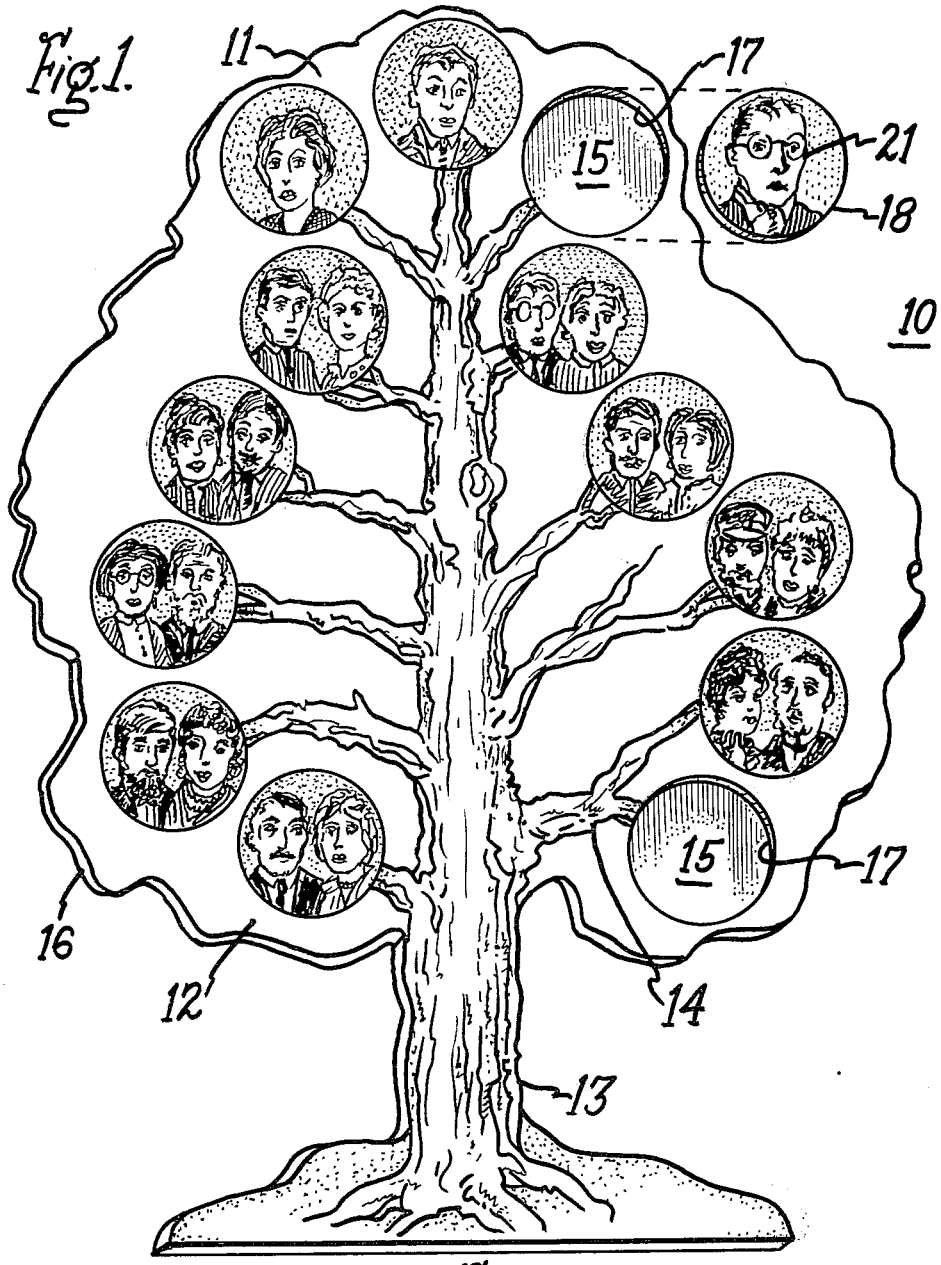
FIG. 1 is a front perspective view of the family tree panel used with the instant invention.

A family tree 10 is shown in FIG. 1 such that a top portion 11 is narrower than a base portion 12 and carries indicia of a stem 13 interconnecting a plurality of branches 14. Connecting with each individual branch 14 is a corresponding slot 15 extending within the thickness 16 of tree 10. A recess 17 is provided within each slot 15 to retain a token 18 carrying the facial indicia 19 of selected ancestors. At the start of the game, each player is given a tree 10 and a plurality of tokens 18 are available for insertion within slots 15. The game is completed when one player fills all slots 15 within his own tree 10. In order to acquire tokens 18, a deck of cards is provided.

Figure 2:
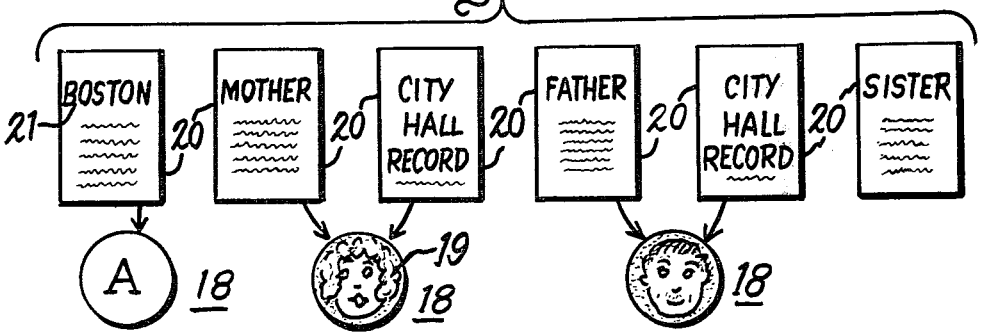
FIG. 2 is a plan view of a player's hand of cards and the associated tokens used for insertion within the family tree panel depicted in FIG. 1.

FIG. 2 shows six cards 20 constituting one hand dealt from the deck to one of the players. Each card 20 contains descriptive indicia 21 that names a particular relative described as an inheritance card, an American city, described as a city location card, or a research source described as a vital record card. Sixteen city location cards, eight city vital record cards, eight church vital record cards, eight miscellaneous vital record cards, four archive vital record cards, four inheritance cards, and four inconclusive research cards are combined with 46 relative cards, such that a total of 98 cards are used within the deck. The relationship between the city location card and the first letter of a player's surname is shown in FIG. 3. A person drawing a card 20 having descriptive indicia 21 as Boston for a city location would be entitled to a token 18 having a surname beginning with A. A token depicting the person having this surname would then be inserted at the top slot 15 with family tree 10 of FIG. 1. A total of some 104 tokens are usually employed. The cards are dealt six to a player and the hand shown in FIG. 2 would be paired accordingly to the arrangement in FIG. 4. A card bearing descriptive indicia 21 "mother" must be paired with a city vital record such as descriptive indicia 21 depicted as "city hall" for a player to obtain a token 18 having descriptive indicia 21 depicting the facial characteristics of a woman.

Figure 5:
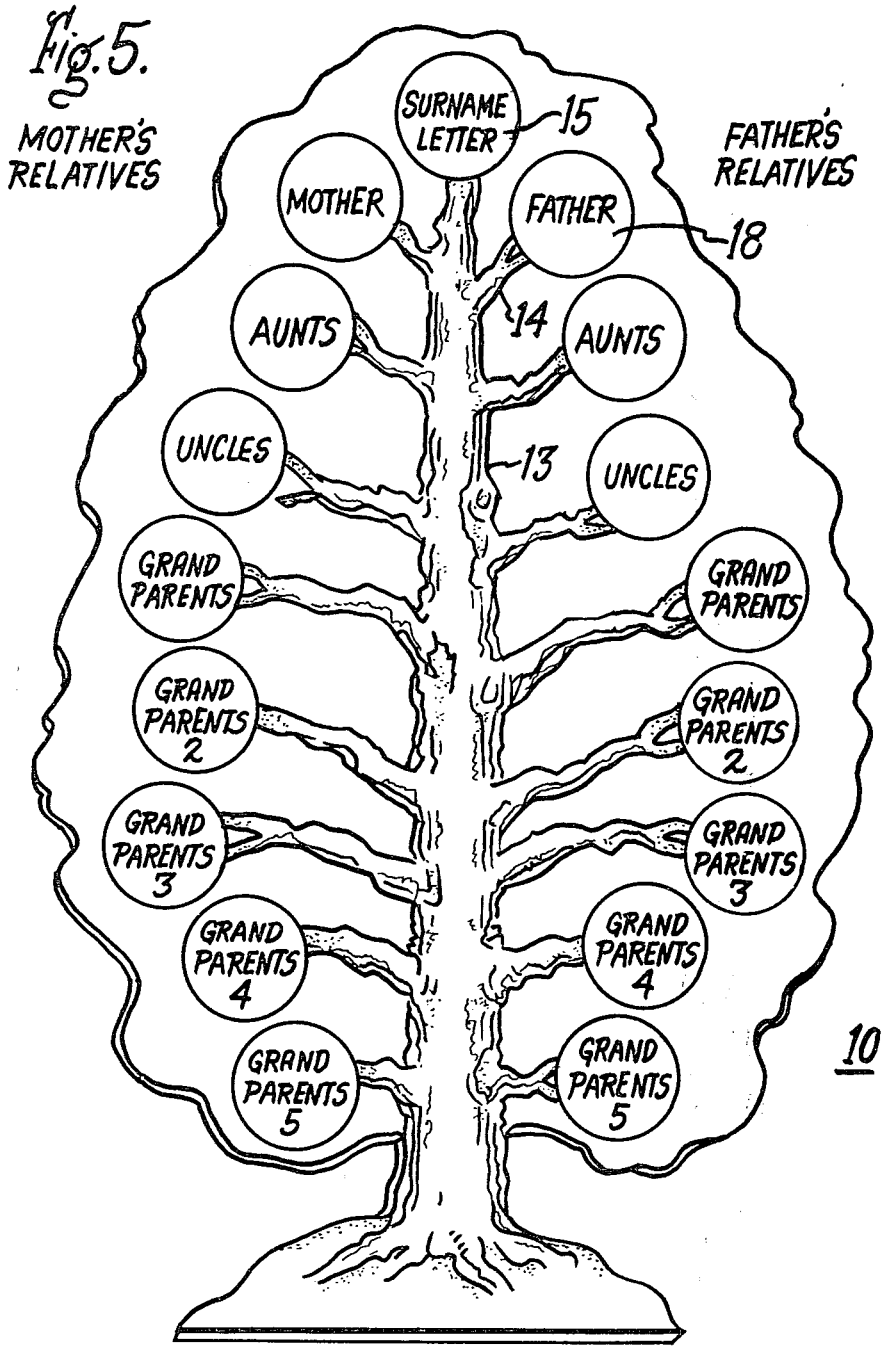
FIG. 5 is a front view of a family tree depicted in FIG. 1 showing several generations of ancestry for both the mother and father sides of a typical family tree relationships.

FIG. 5 shows the progression along family tree 10 from the top token slot 15 which would contain a token 18 carrying surname A for the hand shown in FIG. 2. Stem 13 and branches 14 interconnect the relationship shown to the left which comprise the player's relatives on the mother's side and the relationships to the right which depict the relationship on the father's side. A person playing the hand depicted in FIG. 2 would therefore receive three tokens 18 depicting surname A, mother, and father for insertion within slots 15 in FIG 5. The next player having been dealt six cards, would then selectively pair his cards according to the match indicated in FIG. 4 to receive his appropriate tokens 18. As many as eight players may compete in the game at one time, although four players are usually employed. The family tree 10 can contain eleven slots 15 as shown in FIG. 1 or 17 or more slots 15 as depicted in the family tree 10 shown in FIG. 5. Tree 10 of FIG. 5 contains a plurality of tokens 18 which are the reverse side of tokens 18 of FIG. 1 denoting the family member depicted by the facial indicia 21 shown in FIG. 1. Once the cards are dealt, either six or three to each player, the remainder of the cards are placed face downward on the table. In order to be able to acquire any family tree tokens 18, a player must acquire a city location card which is turned face upward in front of the player, giving the player's surname and entitling the player to begin matching relative and research cards. As described earlier, one relative card must be matched with one research card for a player to acquire a corresponding token 18. Besides the particular relative cards listed in FIG. 4 and the corresponding vital records cards, there are four inheritance cards and four inconclusive research cards. Acquiring an inheritance card allows the player to select one family tree token 18 which can represent any particular family member on tree 10. The inheritance card, therefore, corresponds to a "wild" card and is a benefit often enabling a player to complete a slot 15 for which he does not have the necessary relative card. The inconclusive research cards do not allow any tokens 18 to be acquired and are often discarded. After each player has had a turn, the first player then takes a card from the remaining deck and either matches this card with the card already in his possession or he may discard it face upward. The next player in turn may select the discarded card or, alternatively, take a new card from the deck.

For the relationship depicted in FIG. 5, tokens 18 can have descriptive indicia 21 corresponding to facial characteristics that would depict a mother, uncle, grandmother. Once a player has become proficient in learning the relationship between the various church and municipal sources of research to determine their family ancestry, actual miniature photographs of a person's relatives may be arranged in place of the tokens 18 used. By acquiring actual records, a person can determine his own family tree and can generate a photographic representation thereof if so desired. Thus, the educational American Family Tree Game of the invention teaches the participant the various methods and research locations for generating his own family history to a fairly high degree of accuracy.

What is claimed as new and which it is desired to secure by Letters Patent of the United States is:

1. A family tree game comprising:

A plurality of tokens corresponding to representative family members;

A family tree board containing a plurality of means for retaining said tokens;

Card means for determining the placement of said family tokens on said tree board, said card means containing indicia denoting relatives and research means;

Said retaining means comprising a plurality of slots arranged in an array of two columns, one column denoting maternal ancestry and the other column denoting paternal ancestry;

Said card means comprising a deck of cards wherein said relative cards are designated mother, father, brother, sister, aunt, uncle, grandparent, and wherein said research cards are entitled city vital records, church vital records, archive vital records, miscellaneous records, inheritance cards, and inconclusive research;

Said tokens comprising circular elements having a diameter slightly smaller than the diameter of said slots for insertion within said slots, and containing indicia representing said family members.

2. The game of claim 1 wherein said tokens further contain the name of various family members.

* * * * *